US010864569B2

(12) United States Patent
Kinney

(10) Patent No.: US 10,864,569 B2
(45) Date of Patent: Dec. 15, 2020

(54) BODY PANEL REPAIR ASSEMBLY

(71) Applicant: Robert Kinney, Prince George (CA)

(72) Inventor: Robert Kinney, Prince George (CA)

( * ) Notice: Subject to any disclaimer, the term of this patent is extended or adjusted under 35 U.S.C. 154(b) by 335 days.

(21) Appl. No.: 15/894,559

(22) Filed: Feb. 12, 2018

(65) Prior Publication Data

US 2019/0247904 A1 Aug. 15, 2019

(51) Int. Cl.

| | |
|---|---|
| ***B21D 1/10*** | (2006.01) |
| *B21D 53/88* | (2006.01) |
| *B21D 37/16* | (2006.01) |

(52) U.S. Cl.

CPC ..... *B21D 1/10* (2013.01); *B21D 37/16* (2013.01); *B21D 53/88* (2013.01)

(58) Field of Classification Search

CPC . B21D 1/06; B21D 1/065; B21D 1/08; B21D 1/10; B21D 1/12; B21D 37/16; B23P 9/04

See application file for complete search history.

(56) References Cited

U.S. PATENT DOCUMENTS

| | | | | |
|---|---|---|---|---|
| 3,050,099 | A | 8/1962 | Smith | |
| 3,852,990 | A * | 12/1974 | Sparling | B21D 1/06 72/342.4 |
| 4,260,439 | A | 4/1981 | Speer | |
| 4,419,566 | A | 12/1983 | Fortune | |
| 5,026,188 | A | 6/1991 | Capodieci | |
| 5,653,835 | A | 8/1997 | Glen | |
| 6,633,021 | B2 | 10/2003 | Matubara | |
| 2007/0144653 | A1 | 6/2007 | Padilla et al. | |
| 2008/0163661 | A1 * | 7/2008 | Meichtry | B21D 1/06 72/56 |

* cited by examiner

*Primary Examiner* — Pradeep C Battula

(57) ABSTRACT

A body panel repair assembly for repairing a dent includes a block that is metallic and configured to conduct heat. The block is configured to couple to a head of a jack so that the jack is configured to position the block in abutment to a dent in a body panel. A heating element is coupled to the block. A controller is configured to selectively operationally couple the heating element to a source of alternating current so that the heating element is positioned to heat the block. The block is positioned to transfer heat to the dent in the body panel concurrent with the jack applying a force through the block to the dent to repair the dent.

14 Claims, 3 Drawing Sheets

BODY PANEL REPAIR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to repair assemblies and more particularly pertains to a new repair assembly for repairing a dent.

BRIEF SUMMARY OF THE INVENTION

An embodiment of the disclosure meets the needs presented above by generally comprising a block that is metallic and configured to conduct heat. The block is configured to couple to a head of a jack so that the jack is configured to position the block in abutment to a dent in a body panel. A heating element is coupled to the block. A controller is configured to selectively operationally couple the heating element to a source of alternating current so that the heating element is positioned to heat the block. The block is positioned to transfer heat to the dent in the body panel concurrent with the jack applying a force through the block to the dent to repair the dent.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
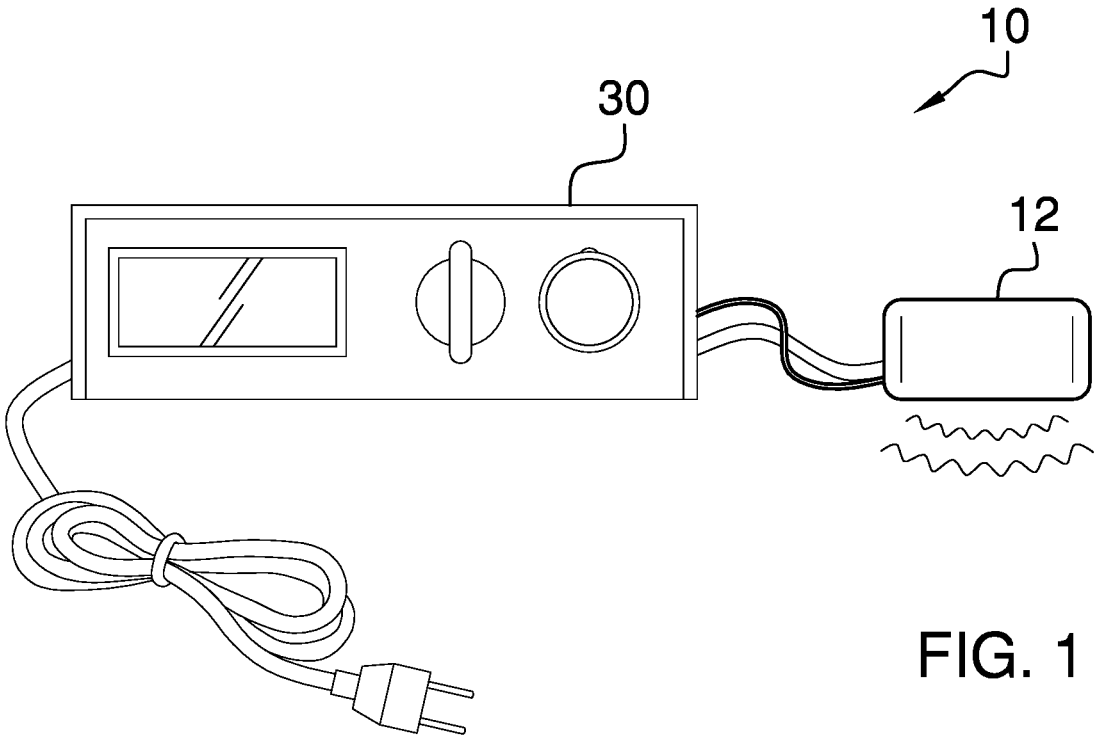
FIG. 1 is a front view of a body panel repair assembly according to an embodiment of the disclosure.

With reference now to the drawings, and in particular to FIGS. 1 through 5 thereof, a new repair assembly embodying the principles and concepts of an embodiment of the disclosure and generally designated by the reference numeral 10 will be described.

Figure 2:
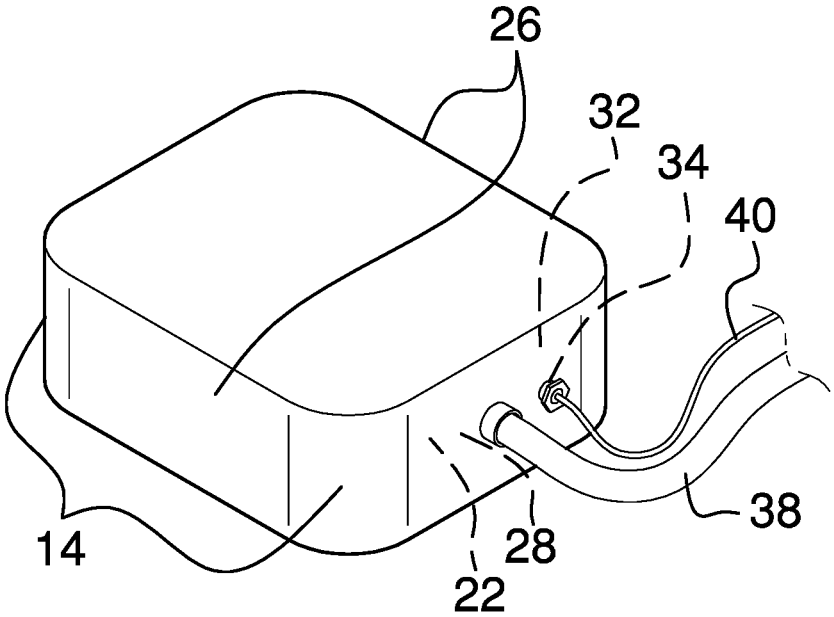
FIG. 2 is an isometric perspective view of an embodiment of the disclosure.

As best illustrated in FIGS. 1 through 5, the body panel repair assembly 10 generally comprises a block 12 that is metallic and configured to conduct heat. The block 12 is configured to couple to a head of a jack. The jack is configured to position the block 12 in abutment to a dent in a body panel. The block 12 is substantially rectangularly box shaped. The block 12 has corner edges 14 that are arcuate, as shown in FIG. 2. The block 12 comprises aluminum or the like.

Figure 3:
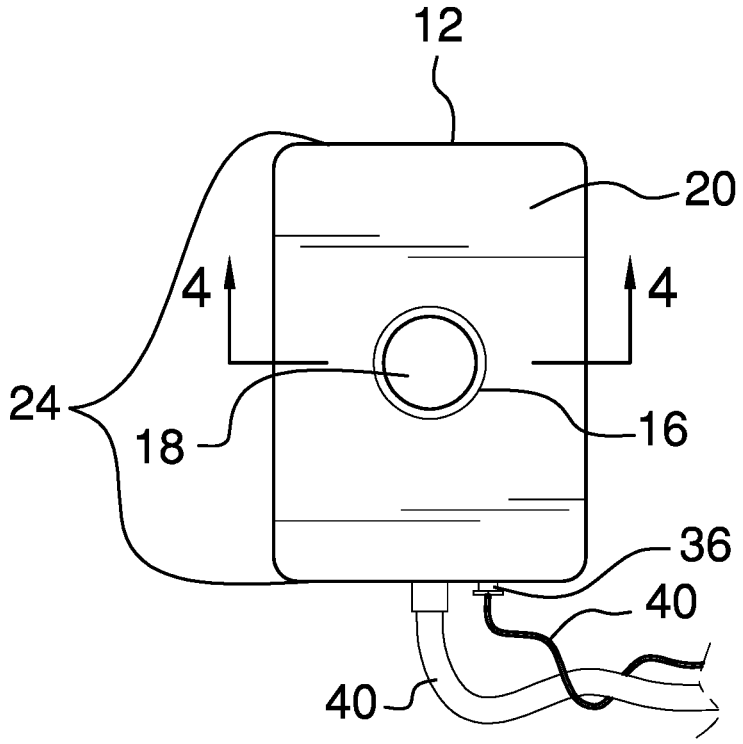
FIG. 3 is a bottom view of an embodiment of the disclosure.

A coupler 16 is coupled to the block 12. The coupler 16 is configured to couple to the head of the jack. The coupler 16 comprises a recess 18 that is positioned in a bottom 20 of the block 12, as shown in FIG. 3. The recess 18 is complementary to the head of the jack. The recess 18 is configured to insert the head of the jack to couple the block 12 to the jack. The recess 18 is circularly shaped when viewed from the bottom 20.

Figure 4:
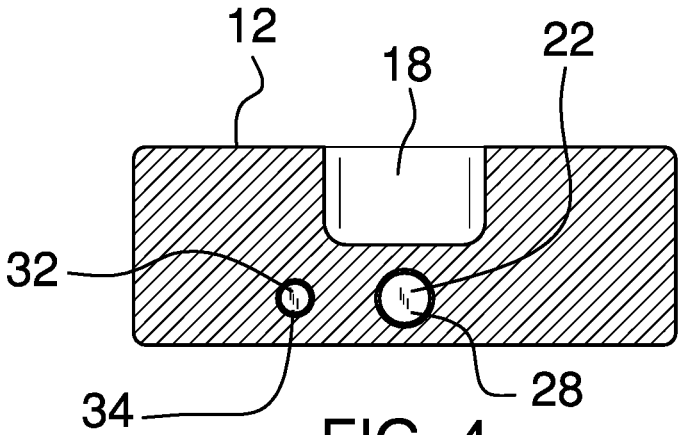
FIG. 4 is a cross-sectional view of an embodiment of the disclosure.

A first channel 22 extends into the block 12 from a respective opposing end 24 of the block 12. The first channel 22 is positioned equally distant from opposing sides 26 of the block 12. The first channel 22 is circularly shaped when viewed from the respective opposing end 24, as shown in FIG. 4. A heating element 28 is coupled to the block 12. The heating element 28 is positioned in the first channel 22.

A controller 30 is configured to selectively operationally couple the heating element 28 to a source of alternating current. The controller 30 is positioned to selectively couple the heating element 28 to the source of alternating current so that the heating element 28 is positioned to heat the block 12.

Figure 5:
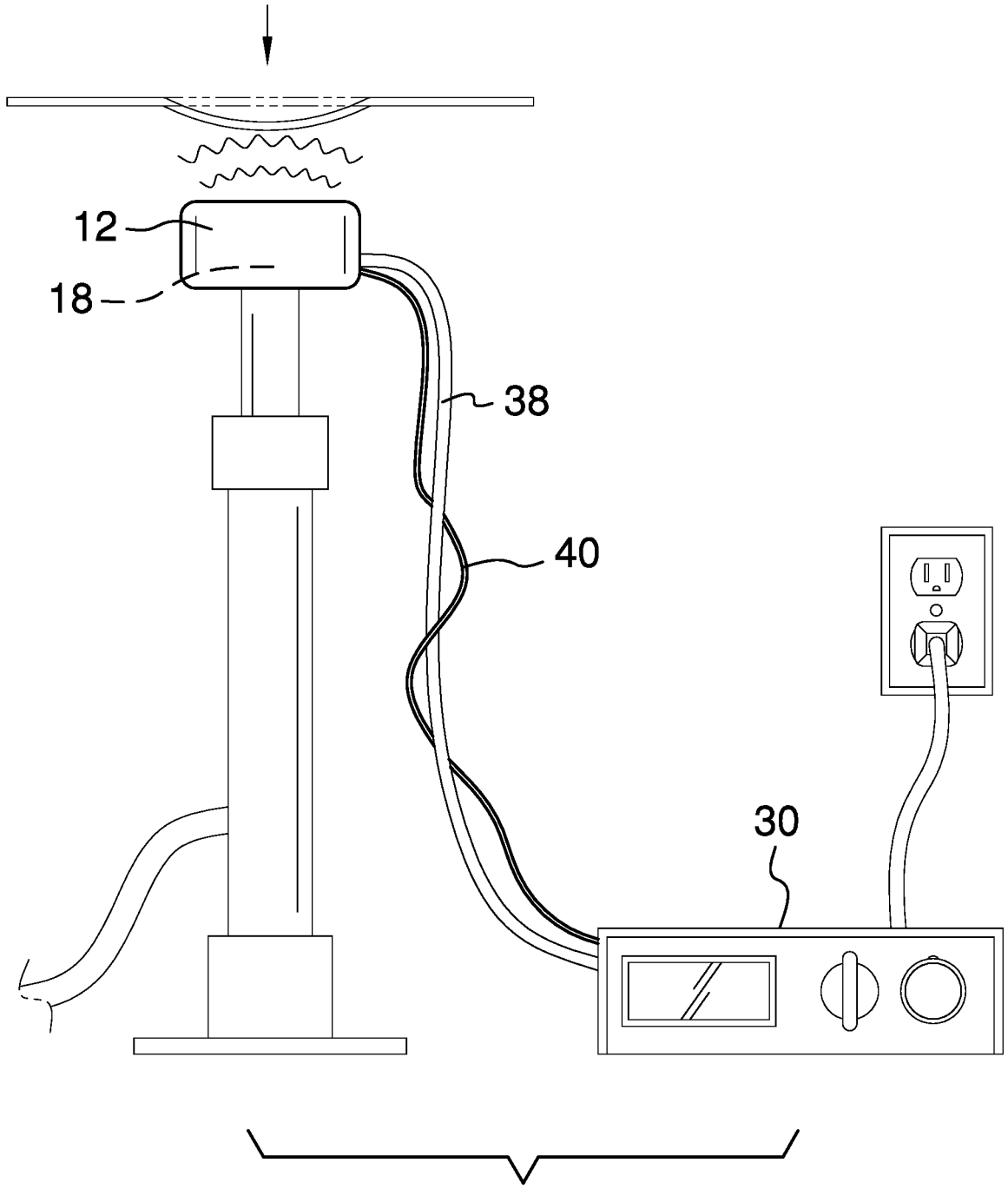
FIG. 5 is an in-use view of an embodiment of the disclosure.

An example of use of the assembly 10 is depicted in FIG. 5. The user identifies the body panel with the dent that requires repair. The body panel may comprise metal, plastic, or the like. The user fixedly positions the body panel relative to a jack such that the head of the jack is positioned to apply a force to the dent in the body panel. In this example, the block 12 is coupled to the head of a hydraulic jack by inserting the head into the recess 18 in the bottom 20 of the block 12. The base of the hydraulic jack is positioned on a surface. The body panel in which the dent is positioned is fixedly positioned relative to the hydraulic jack, with the block 12 positioned proximate to or in contact with the dent. The controller 30 is positioned to selectively couple the heating element 28 to the source of alternating current so that the heating element 28 is positioned to heat the block 12. The block 12 is positioned to transfer heat to the dent in the body panel concurrent with the jack applying the force through the block 12 to the dent to repair the dent.

A second channel 32 extends into the block 12 from the respective opposing end 24 of the block 12. The second channel 32 is positioned between the first channel 22 and a respective opposing side 26 of the block 12. The second channel 32 is circularly shaped when viewed from the respective opposing end 24, as shown in FIG. 4. A sensor 34 is coupled to the block 12. The sensor 34 is configured to measure temperature. The sensor 34 comprises a thermometer 36, a thermocouple, or the like. The sensor 34 is positioned in the second channel 32. The sensor 34 is operationally coupled to the controller 30.

The sensor 34 is positioned to measure a temperature of the block 12 and to communicate a temperature measurement to the controller 30 so that the controller 30 is positioned to utilize continuous variation of output to maintain the temperature of the block 12.

A first wire 38 is coupled to and extends between the controller 30 and the heating element 28 to operationally couple the heating element 28 to the controller 30. A second wire 40 is coupled to and extends between the controller 30 and the sensor 34 to operationally couple the sensor 34 to the controller 30.

In use, the controller 30 is positioned to selectively couple the heating element 28 to the source of alternating current so that the heating element 28 is positioned to heat the block 12. The block 12 is positioned to transfer heat to the dent in the body panel concurrent with the jack applying the force through the block 12 to the dent to repair the dent.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A body panel repair assembly comprising:

a block, said block being metallic such that said block is configured for conducting heat, said block being configured for coupling to a head of a jack such that the jack is configured for positioning said block in abutment to a dent in a body panel;

a heating element coupled to said block;

a controller configured for selectively operationally coupling said heating element to a source of alternating current;

wherein said heating element is positioned in said block such that said controller is positioned for selectively coupling said heating element to the source of alternating current such that said heating element is positioned for heating said block such that said block is positioned for transferring heat to the dent in the body panel concurrent with the jack applying a force through said block to the dent for repairing the dent;

a first channel and a second channel extending into said block from said respective opposing ends of said block; and a sensor coupled to said block, said sensor being configured for measuring temperature, said sensor being operationally coupled to said controller, wherein said sensor is positioned on said block such that said sensor is positioned for measuring a temperature of said block and communicating a temperature measurement to said controller such that said controller is configured for continuous variation of output for maintaining the temperature of said block, said sensor being positioned in said second channel.

2. The assembly of claim 1, further including said block being substantially rectangular box shaped.

3. The assembly of claim 2, further including said block having corner edges, said corner edges being arcuate.

4. The assembly of claim 1, further including said block comprising aluminum.

5. The assembly of claim 1, further including a coupler coupled to said block, said coupler being configured for coupling to the head of the jack.

6. The assembly of claim 5, further including said coupler comprising a recess positioned in a bottom of said block, said recess being configured to be complementary to the head of the jack, wherein said recess is positioned in said block such that said recess is configured for inserting the head of the jack for coupling said block to the jack.

7. The assembly of claim 6, further including said recess being circularly shaped when viewed from said bottom of said block.

8. The assembly of claim 1, further including:

said heating element being positioned in said first channel.

9. The assembly of claim 8, further including said first channel being positioned equally distant from opposing sides of said block.

10. The assembly of claim 8, further including said first channel being circularly shaped when viewed from said respective opposing end.

11. The assembly of claim 1, further including said second channel being positioned between said first channel and a respective said opposing side of said block.

12. The assembly of claim 1, further including said second channel being circularly shaped when viewed from said respective opposing end.

13. The assembly of claim 1, further including comprising:

a first wire coupled to and extending between said controller and said heating element for operationally coupling said heating element to said controller; and a second wire coupled to and extending between said controller and said sensor for operationally coupling said sensor to said controller.

14. A body panel repair assembly comprising:

a block, said block being metallic such that said block is configured for conducting heat, said block being configured for coupling to a head of a jack such that the jack is configured for positioning said block in abutment to a dent in a body panel, said block being substantially rectangular box shaped, said block having corner edges, said corner edges being arcuate, said block comprising aluminum;

a coupler coupled to said block, said coupler being configured for coupling to the head of the jack, said coupler comprising a recess positioned in a bottom of said block, said recess being complementary to the head of the jack, wherein said recess is positioned in said block such that said recess is configured for inserting the head of the jack for coupling said block to the jack, said recess being circularly shaped when viewed from said bottom;

a first channel extending into said block from a respective opposing end of said block, said first channel being positioned equally distant from opposing sides of said block, said first channel being circularly shaped when viewed from said respective opposing end;

a heating element coupled to said block, said heating element being positioned in said first channel;

a controller configured for selectively operationally coupling said heating element to a source of alternating current, wherein said heating element is positioned in said block such that said controller is positioned for selectively coupling said heating element to the source of alternating current such that said heating element is positioned for heating said block such that said block is positioned for transferring heat to the dent in the body panel concurrent with the jack applying a force through said block to the dent for repairing the dent;

a first wire coupled to and extending between said controller and said heating element for operationally coupling said heating element to said controller;

a second channel extending into said block from said respective opposing end of said block, said second channel being positioned between said first channel and a respective said opposing side of said block, said second channel being circularly shaped when viewed from said respective opposing end;

a sensor coupled to said block, said sensor being configured for measuring temperature, said sensor being operationally coupled to said controller, wherein said sensor is positioned on said block such that said sensor is positioned for measuring a temperature of said block and communicating a temperature measurement to said controller such that said controller is positioned for continuous variation of output for maintaining the temperature of said block, said sensor being positioned in said second channel; and a second wire coupled to and extending between said controller and said sensor for operationally coupling said sensor to said controller.

* * * * *